US006236364B1

(12) United States Patent
Petersson et al.

(10) Patent No.: US 6,236,364 B1
(45) Date of Patent: May 22, 2001

(54) METHOD AND ARRANGEMENT FOR IMPROVING NULL DEPTHS

(75) Inventors: Sven Petersson, Sävedalen; Björn Johannisson, Kungsbacka; Sören Andersson, Sollentuna, all of (SE)

(73) Assignee: Telefonaktiebolaget LM Ericsson (publ), Stockholm (SE)

( * ) Notice: Subject to any disclaimer, the term of this patent is extended or adjusted under 35 U.S.C. 154(b) by 0 days.

(21) Appl. No.: 09/408,069

(22) Filed: Sep. 29, 1999

(30) Foreign Application Priority Data

Sep. 30, 1998 (SE) ..... 9803317

(51) Int. Cl.[7] ..... H01Q 21/24
(52) U.S. Cl. ..... 342/361
(58) Field of Search ..... 342/361, 362, 342/363, 364, 365, 366, 379

(56) References Cited

U.S. PATENT DOCUMENTS 4,233,607 * 11/1980 Sanford et al. ..... 343/700 MS
4,335,388 6/1982 Scott et al. .
4,623,891 * 11/1986 Johnson ..... 342/361
4,811,023 3/1989 Gelernter et al. .

FOREIGN PATENT DOCUMENTS 4-108201 4/1992 (JP) .

* cited by examiner

*Primary Examiner*—Thomas H. Tarcza
*Assistant Examiner*—Fred H. Mull
(74) *Attorney, Agent, or Firm*—Burns, Doane, Swecker & Mathis, L.L.P.

(57) ABSTRACT

To improve null depths in an antenna pattern of a first polarization, formed with nulls in at least one angular region, a further antenna pattern of a second polarization, substantially orthogonal to the first polarization, is concurrently formed. In the angular region, the amplitudes of the copolar components of the further antenna pattern are substantially equal to the amplitudes of the crosspolar components of the antenna pattern of the first polarization, and the phases of the copolar components of the further antenna pattern of the second polarization are substantially opposite to the phases of the crosspolar component of the first polarization.

6 Claims, 3 Drawing Sheets

METHOD AND ARRANGEMENT FOR IMPROVING NULL DEPTHS

This application claims priority under 35 U.S.C. §§ 119 and/or 365 to 9803317-8, filed in Sweden on Sep. 30, 1998; the entire content of which is hereby incorporated by reference.

TECHNICAL FIELD

The invention relates generally to radiation suppression and, more specifically, to a method and an arrangement for improving null depths in antenna patterns.

BACKGROUND

In systems such as mobile communication systems, radar systems etc., it is sometimes of interest to suppress radiation of signal power in certain directions. The reason for doing this in e.g. a mobile communication system is typically to reduce interference and, thus, improve system performance.

A typical property of an antenna is that, in the main lobe direction, crosspolar components are significantly suppressed in comparison with copolar components, whereas, in side lobe directions, the crosspolar components may be of the same magnitude as the copolar components. This means that when a null is formed in a certain direction or angular region on the basis of the copolar components, the depth of that null will be limited by the crosspolar components.

SUMMARY

The object of the invention is to eliminate the limitation of the null depth caused by the crosspolar components.

This is generally attained in accordance with the invention by further attenuating the crosspolar components in the direction or region where nulls are desired.

Hereby, the crosspolar components will not limit the null depth.

BRIEF DESCRIPTION OF THE DRAWINGS

The invention will be described more in detail below with reference to the appended drawings on which

DETAILED DESCRIPTION

Figure 1:
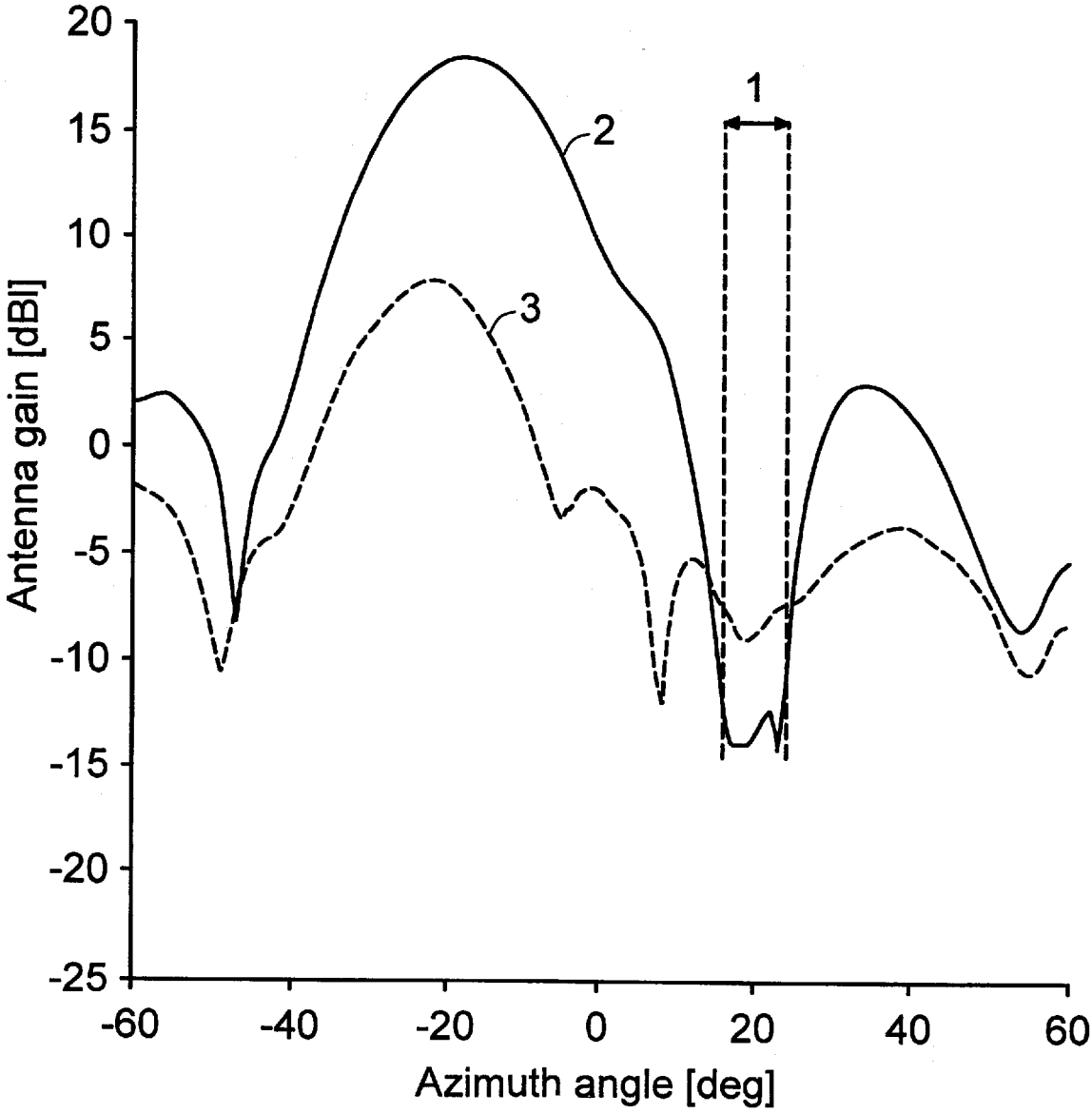
FIG. 1 illustrates an example of an antenna pattern with limited null depth.

FIG. 1 illustrates an antenna pattern formed, on the basis of copolar components, with nulls in an angular region 1 around an azimuth angle of 20°, and a main lobe at an azimuth angle of about −20°. There may of course by more than one null region in the antenna pattern. The antenna gain levels are given in dBi, i.e. the radiation intensity is expressed in decibels with reference to the radiation intensity of an ideal, isotropic antenna with the same input power.

In FIG. 1, copolar components are represented by a solid line 2, while crosspolar components are represented by a broken line 3.

The antenna pattern illustrated in FIG. 1 may be generated by applying a proper steering vector to an array antenna (not shown). It is however to be understood, that the antenna pattern equally well may be generated by means of other types of antennas.

In the null region 1 in FIG. 1, the copolar components, as represented by the solid line 2, are attenuated to about −14 dBi, while the crosspolar components, as represented by the broken line 3, are attenuated to about −8 dBi.

Thus, in the null region 1, the null depth in the antenna pattern is limited by the crosspolar components as represented by the broken line 3.

Figure 2:
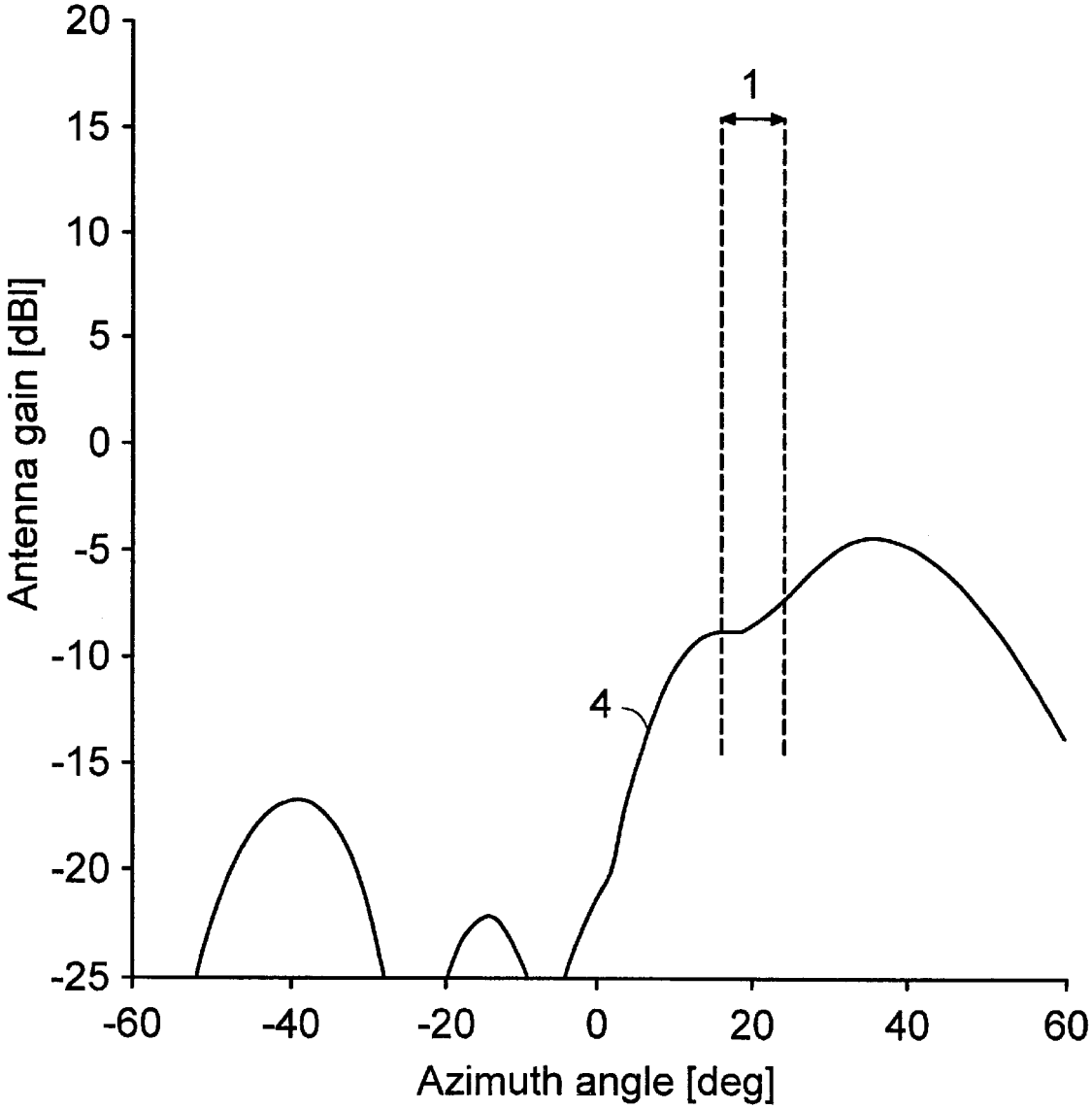
FIG. 2 illustrates an example of an antenna pattern to be used to improve the null depth in the antenna pattern in FIG. 1.

In accordance with the invention, to improve the null depth in the null region 1, a further antenna pattern illustrated in FIG. 2, is formed. In FIG. 2, only copolar components of the further antenna pattern are illustrated by means of a solid line 4, since only the copolar components of the further antenna pattern are used in order to improve the null depth of the null region 1 in FIG. 1. The crosspolar components of the further antenna pattern are normally considerably lower than the copolar components and will therefore have a negligible influence.

In accordance with the invention, the antenna pattern illustrated in FIG. 2 is formed of a polarization which is substantially orthogonal to the polarization of the antenna pattern illustrated in FIG. 1.

The antenna patterns illustrated in FIGS. 1 and 2 may be formed by means of a single antenna (not shown), e.g. an array antenna with dual polarized radiation elements. However, it is to be understood that the antenna patterns in FIGS. 1 and 2 equally well may be formed by means of two separate antennas (not shown), e.g. two separate array antennas with single polarized radiation elements. The two separate antennas may be integrated into one mechanical unit but are still functionally separated.

Moreover, in accordance with the invention, the antenna forming the further antenna pattern illustrated in FIG. 2, is controlled in such a manner that, in the desired null region 1, the copolar components of the further antenna pattern, as represented by the solid line 4, have amplitudes which are substantially equal to the amplitudes of the crosspolar components of the antenna pattern in the null region 1 in FIG. 1, as represented by the broken line 3 in FIG. 1.

Furthermore, in accordance with the invention, the antenna forming the further antenna pattern illustrated in FIG. 2, is controlled in such a manner that, in the desired null region 1, the copolar components, as represented by the solid line 4, have phases which are substantially opposite to the phases of the crosspolar components of the antenna pattern in the null region 1 in FIG. 1, as represented by the broken line 3 in FIG. 1.

In accordance with the invention, by concurrently forming the antenna patterns illustrated in FIGS. 1 and 2, in this example, the crosspolar components in the antenna pattern in FIG. 1 will be suppressed to about the same level as the copolar components in the null region 1 in FIG. 1.

Figure 3:
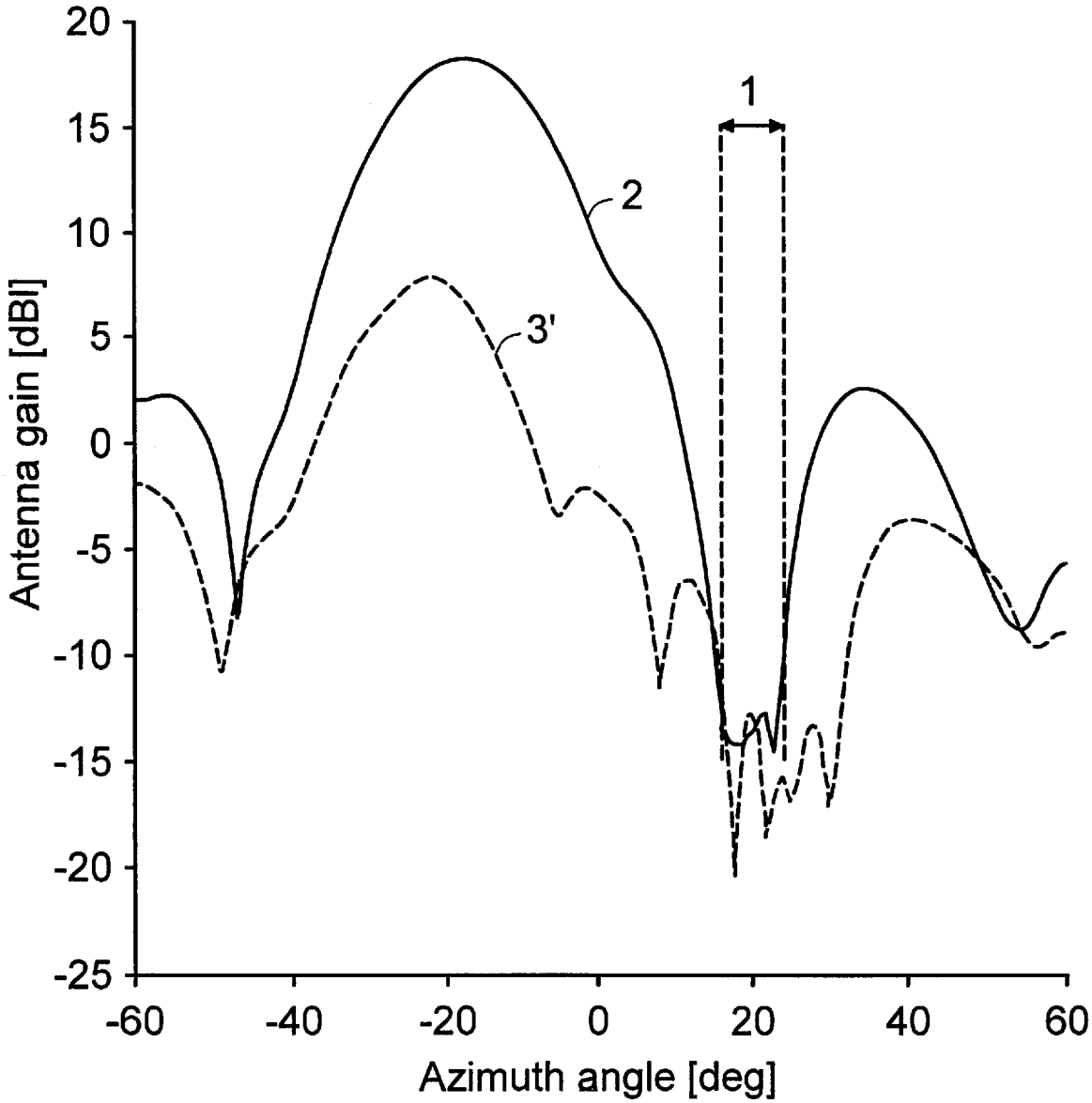
FIG. 3 illustrates the antenna pattern in FIG. 1 with improved null depth.

This is illustrated in FIG. 3, from which it is apparent that the copolar components, as represented by the solid line 2, have not been affected by the copolar components of the antenna pattern in FIG. 2, as represented by the solid line 4. However, as apparent from FIG. 3, the crosspolar components, as now represented by a broken line 3', have now been attenuated to about −14 dBi within the null region 1 as well as close thereto, i.e. to about the same level as the copolar components as represented by the solid line 2.

Thus, to improve the null depths in an antenna pattern formed of a first polarization with nulls in at least one angular region, a further antenna pattern of a second polarization, substantially orthogonal to the first polarization, is concurrently formed. In the desired null region, the copolar components of the further antenna pattern should have amplitudes which are substantially equal to the amplitudes of the crosspolar components of the antenna pattern of the first polarization in that angular region, and phases which are substantially opposite to the phases of the crosspolar components of the antenna pattern of the first polarization in that angular region.

Hereby, the crosspolar components of the antenna pattern of the first polarization will be further suppressed in that angular region.

What is claimed is:

1. A method of improving null depths in an antenna pattern formed with nulls in at least one angular region, and being of a first polarization, the method comprising: concurrently forming a further antenna pattern of a second polarization, substantially orthogonal to said first polarization, and controlling the copolar components of said further antenna pattern of said second polarization to have, in said at least one angular region, amplitudes which are substantially equal to the amplitudes of the crosspolar components of said antenna pattern of said first polarization in said at least one angular region and phases which are substantially opposite to the phases of the crosspolar components of said antenna pattern of said first polarization in said at least one angular region to suppress the crosspolar components of said antenna pattern of said first polarization in said at least one angular region.

2. The method as claimed in claim 1, wherein the antenna patterns are formed by a single antenna.

3. The method as claimed in claim 1, wherein the antenna patterns are formed by separate antennas.

4. An arrangement for improving null depths in an antenna pattern comprising: first antenna means for forming the antenna pattern of a first polarization with nulls in at least one angular region, and second antenna means for concurrently forming a further antenna pattern of a second polarization, substantially orthogonal to said first polarization, said second antenna means being adapted to control the copolar components of said further antenna pattern of said second polarization to have, in said at least one angular region, amplitudes which are substantially equal to the amplitudes of the crosspolar components of said antenna pattern of said first polarization in said at least one angular region and phases which are substantially opposite to the phases of the crosspolar components of said antenna pattern of said first polarization in said at least on angular region to suppress the crosspolar components of said antenna pattern of the said first polarization in said at least one angular region.

5. The arrangement as claimed in claim 4, wherein said first antenna means and said second antenna means together form a single antenna.

6. The arrangement as claimed in claim 4, wherein said first and second antenna means form separate antennas.

* * * * *